US009623669B2

(12) United States Patent
Kato et al.

(10) Patent No.: US 9,623,669 B2
(45) Date of Patent: Apr. 18, 2017

(54) INK SUPPLY DEVICE FOR PRINTHEAD

(71) Applicant: Panasonic Intellectual Property Management Co., Ltd., Osaka (JP)

(72) Inventors: Takahisa Kato, Kumamoto (JP); Hiroyuki Matsuba, Fukuoka (JP); Yousuke Toyofuku, Fukuoka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/075,105

(22) Filed: Mar. 19, 2016

(65) Prior Publication Data

US 2016/0288520 A1 Oct. 6, 2016

(30) Foreign Application Priority Data

Mar. 30, 2015 (JP) ..... 2015-069701

(51) Int. Cl.
*B41J 2/175* (2006.01)
*B41J 2/055* (2006.01)

(52) U.S. Cl.
CPC ..... *B41J 2/17596* (2013.01); *B41J 2/055* (2013.01); *B41J 2/175* (2013.01); *B41J 2/17503* (2013.01); *B41J 2/17509* (2013.01); *B41J 2/17556* (2013.01)

(58) Field of Classification Search
CPC .... B41J 2/17596; B41J 2/17556; B41J 2/055; B41J 2/17509; B41J 2/175; B41J 2/17503
See application file for complete search history.

(56) References Cited

U.S. PATENT DOCUMENTS

2005/0073559 A1 4/2005 Aruga et al.
2012/0151738 A1* 6/2012 Price ..... B41J 2/17513 29/428
2012/0154491 A1* 6/2012 Price ..... B41J 2/17556 347/85

FOREIGN PATENT DOCUMENTS

JP 3606282 B 1/2005

* cited by examiner

*Primary Examiner* — Justin Seo
(74) *Attorney, Agent, or Firm* — McDermott Will & Emery LLP

(57) ABSTRACT

An ink supply device for a printhead includes an ink cartridge and a damper device. The ink cartridge is connected to the printhead through a flexible tube. The printhead is mounted on a carriage that reciprocates, and discharges an ink drop to perform printing. The damper device is mounted on the carriage to relax pressure fluctuation of ink supplied from the ink cartridge to the printhead. The damper device has a case, an ink introduction passage, and a flexible plate. The case defines a pressure chamber communicated with the printhead. The ink introduction passage is communicated with the flexible tube, and is communicated with the pressure chamber. The flexible plate is provided so as to define a part of the pressure chamber, and has a waveform portion formed with a plurality of waveforms.

4 Claims, 8 Drawing Sheets

INK SUPPLY DEVICE FOR PRINTHEAD

BACKGROUND

1. Field of the Invention

The present disclosure relates to an ink supply device for a printhead using a damper device for relaxing pressure fluctuation generated in ink in a printhead for discharging the ink.

2. Description of the Related Art

Conventionally, there are ink jet printers for business use in addition to ink jet printers for home use among ink jet printers for discharging a very small amount of ink drops to perform printing. In the ink jet printers for home use, there is a so-called on-carriage type ink jet printer which each ink cartridge for supplying each color ink is mounted on a printhead having a nozzle for discharging ink drops from its opening. In a case of such an on-carriage type ink jet printer, it is difficult to increase the size of the ink cartridge when dimensions of an area (height, for example) for mounting each ink cartridge on the carriage are restricted. Thus, the on-carriage type ink jet printer is inadequate for a large amount of printing by continuous printing.

In the ink jet printers for business use, there is an ink jet printer using a structure (off-carriage type) in which an ink cartridge is separately provided from a carriage, a printhead mounted on the carriage is connected to the ink cartridge through a flexible tube, and ink is supplied from the ink cartridge to the printhead (refer to Japanese Patent No. 3606282). Consequently, it is possible to increase the capacity of the ink cartridge, and it is possible to perform a large amount of printing by continuous printing.

SUMMARY

An ink supply device for a printhead of the present disclosure includes an ink cartridge and a damper device. The ink cartridge is connected to the printhead through a flexible tube. The printhead is mounted on a carriage that reciprocates, and discharges an ink drop to perform printing. The damper device is mounted on the carriage to relax pressure fluctuation of ink supplied from the ink cartridge to the printhead. The damper device has a case, an ink introduction passage, a valve body, a spring, a flexible plate, and a transmission member. The case defines a pressure chamber communicated with the printhead. The ink introduction passage is communicated with the flexible tube, and is communicated with the pressure chamber. The valve body is provided between the ink introduction passage and the pressure chamber. The spring urges the valve body in a valve closing direction. The flexible plate is provided so as to define a part of the pressure chamber and receive atmospheric pressure. The transmission member is provided between a predetermined part of the flexible plate and the valve body to transmit displacement of the flexible plate to the valve body. The flexible plate has a waveform portion formed with a plurality of waveforms.

According to the present disclosure, the waveform portion of the flexible plate can largely deform, so that a displacement amount in a valve opening direction of the valve body can be increased, and therefore it is possible to enhance urging force of a spring in the valve closing direction by increasing a deformation amount of the spring. Therefore, it is possible to suppress an influence caused by pressure fluctuation of ink, and keep good printing quality without reduction in an opening amount of a valve during normal printing.

DETAILED DESCRIPTION OF THE PREFERRED EMBODIMENTS

Figure 1:
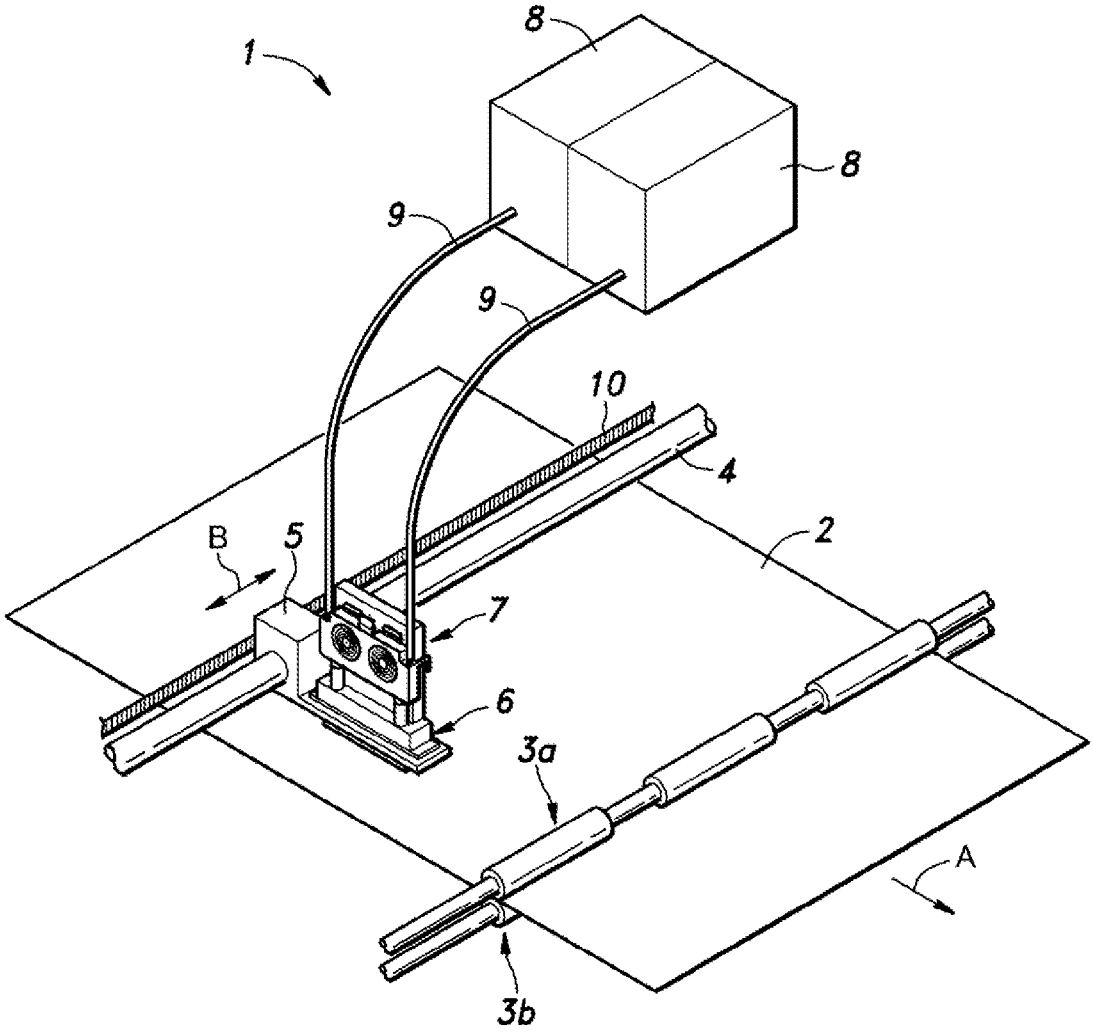
FIG. 1 is a perspective view of a main part of an ink jet printer to which the embodiment of the present disclosure is applied.

Some ink jet printers are provided with a damper device for keeping back pressure (slight negative gauge pressure for holding ink to prevent leakage of the ink) of ink at a constant value. The damper device is used for, for example, relaxing pressure fluctuation of ink supplied to a printhead from an ink supply tank provided in a printhead. A damper device disclosed in Japanese Patent No. 3606282 is configured by an ink supply chamber sink introduction passage), a pressure chamber, an ink supply hole, a valve body, and a flexible film member. The ink supply chamber is communicated with an ink cartridge. The pressure chamber is communicated with a nozzle of a printhead. The ink supply hole is provided in a partition wall for partitioning the ink supply chamber (ink introduction passage) and the pressure chamber, and communicates both the chambers. The valve body is urged by a spring in a valve closing direction to openably close the ink supply hole. The flexible film member forms a wall of the pressure chamber along with a pressure receiving plate mounted at the center of the flexible film member. The pressure receiving plate presses the valve body in a valve opening direction by receiving atmospheric pressure.

The above flexible film member is mounted on a case of the printhead by thermal welding. In the mounting of the flexible film member, deflection of the flexible film member is generated by cooling a case after the flexible film member is thermally welded to the heated case. Alternatively, deflection of the flexible film member corresponding to a thickness of a pressure receiving plate, which is previously mounted on the flexible film member by thermal welding, is generated by applying a pressure to the flexible film member from a side of the pressure receiving plate by using a heater block for thermal welding, and making the flexible film member thermally welded to the case. Since the flexible film member is provided with the deflection, the film member, namely the pressure receiving plate is displaceable, and openable operation of a valve between the ink supply chamber (ink introduction passage) and the pressure chamber are performed in response to displacement of the pressure receiving plate.

On the other hand, in the ink jet printer, the printhead reciprocates in a printing direction. Thus, in the above off-carriage type ink jet printer, a tube is repeatedly extensible with reciprocating movement of the printhead. This causes pressure fluctuation of ink in the tube. When pressure of ink in the ink supply chamber (ink introduction passage) is fluctuated by the pressure fluctuation of the ink in the tube, an amount of ink supplied from the ink supply chamber (ink introduction passage) to the pressure chamber is not kept constant. This may affect printing quality. This pressure fluctuation of the ink in the tube becomes maximized at both ends in the reciprocating movement of the printhead.

The valve may be opened due to slight differential pressure between the ink supply chamber (ink introduction passage) and the pressure chamber when an amount of ink filled in the pressure chamber is reduced by discharging the ink, and along with this reduction, force to the valve body in the valve opening direction acts by the pressure receiving plate. In order to prevent such unwilled valve opening, it is considered that spring force for urging the valve body in the valve closing direction is increased.

However, in the damper device disclosed in Japanese Patent No. 3606282, the flexible film member is merely deflected. Accordingly a displacement of the pressure receiving plate by the deflection of the flexible film member is slight, and a displacement of valve body in opening corresponding to the displacement of the pressure receiving plate is also slight. In a case where a spring having a large spring constant is provided in order to generate large spring force at a valve closing state of the valve body, spring urging force (resisting power) becomes large even when the displacement is slight. Therefore, an ink flow rate in valve opening operation during normal printing becomes slight. This may cause trouble in printing. Therefore, there is a problem that spring force cannot be increased, and it is difficult to deal with the influence by the pressure fluctuation of the ink at the both ends in the reciprocating movement of the printhead in the printing direction.

The present disclosure provides an ink supply device for a printhead capable of suppressing an influence caused by pressure fluctuation of ink due to reciprocating movement of a printhead ink jet printer.

A first disclosure is an ink supply device for a printhead includes an ink cartridge and a damper device. The ink cartridge is connected to the printhead through a flexible tube. The printhead is mounted on a carriage that reciprocates, and discharges an ink drop to perform printing. The damper device is mounted on the carriage to relax pressure fluctuation of ink supplied from the ink cartridge to the printhead. The damper device has a case, an ink introduction passage, a valve body, a spring, a flexible plate, and a transmission member. The case defines a pressure chamber communicated with the printhead. The ink introduction passage is communicated with the flexible tube, and is communicated with the pressure chamber. The valve body is provided between the ink introduction passage and the pressure chamber. The spring urges a valve body in a valve closing direction. The flexible plate is provided so as to define a part of the pressure chamber and receive atmospheric pressure. The transmission member is provided between a predetermined part of the flexible plate and the valve body to transmit displacement of the flexible plate to the valve body. The flexible plate has a waveform portion formed with a plurality of waveforms.

According to this configuration, the waveform portion of the flexible plate can largely deform, so that a displacement of the valve body in a valve opening direction can be increased. Thus, it is possible to enhance spring urging force in the valve closing direction by increasing a deformation amount of the spring. Therefore, it is possible to suppress an influence caused by pressure fluctuation of ink, and keep good printing quality without reduction in an opening amount of a valve during normal printing.

According to a second disclosure, in the first disclosure, the waveform portion has large amplitude of waveform on at least a part of an outer peripheral side in the flexible plate.

According to this configuration, since the amplitude of waveform in the waveform portion on the outer peripheral side where an area is large in a view from an axial direction of the flexible plate is large, deformation on the outer peripheral side where large load is received becomes large. Therefore, it is possible to effectively ensure a large displacement of the flexible plate.

According to a third disclosure, in the second disclosure, amplitude of waveform in the waveform portion on the part of the outer peripheral side in the flexible plate is larger than amplitude of waveform in the waveform portion on a part of a central side in the flexible plate.

According to this configuration, since a deformation of the waveform portion on the part of the central side can be relatively reduced, inclination on the part of the central side in a direction in which the valve body is displaced by the flexible plate is suppressed. Consequently, opening operation of the valve body is stabilized, and ink can be stably supplied during opening of the valve.

According to a fourth disclosure, in any of the first to third disclosures, the flexible plate has a barrier layer, a welding layer, and an adhesive layer. The barrier layer is formed of a film member, is provided on a side receiving atmospheric pressure, and has an oxygen barrier property. The welding layer is firmly fixed to the case by thermal welding. The adhesive layer bonds the barrier layer and the welding layer.

According to this configuration, in a case where ink with a small amount of dissolved oxygen is used in an ink jet printer, oxygen from atmosphere can be prevented from entering ink filled in the pressure chamber at standby state or the like.

According to the fifth disclosure, in any of the first to fourth disclosures, the waveform portion is formed with such a length as to stick to at least a wall surface of the pressure chamber at an extending state.

According to this configuration, a length of a material for forming the waveform portion at the extending state is set as a sufficient length, so that it is possible to optimize an amount of the material of the flexible plate, and to obtain a large deformation amount of the flexible plate.

Hereinafter, embodiments of the present disclosure are described with reference to drawings.

FIG. 1 is a perspective view of a main part of ink jet printer 1 to which the embodiment of the present disclosure is applied. In this figure, paper 2 to be printed is conveyed in a direction illustrated by arrow A in the figure. Ink jet printer 1 of an illustrated example is provided with a pair of conveyance rollers 3*a*, 3*b*, carriage 5, printhead 6, and damper device 7. The pair of conveyance rollers 3*a*, 3*b* are configured by fitting of cylindrical rubber rollers to rotating rods in order to convey paper 2. Carriage 5 is supported by rod-like guide rail 4 disposed in parallel to conveyance rollers 3*a*, 3*b*, and reciprocates in directions illustrated by bidirectional arrow B in the figure, which is an axial direction of guide rail 4. Printhead 6 is mounted on carriage 5. Damper device 7 is supported by carriage 5 so as to be disposed on an upper side of printhead 6 (side opposite to paper 2).

In the illustrated example, two ink cartridges 8 are connected to damper device 7 through respective tubes 9. Ink cartridges 8 are separately disposed from carriage 5, and are fixed at a predetermined position of a printer body (not illustrated). Ink stored in ink cartridges 8 is introduced from tubes 9 to damper device 7 and is supplied to printhead 6 through damper device 7.

Carriage 5 is, for example, driven by a servo motor (not illustrated) through timing belt 10. One of a pair of conveyance rollers 3*a*, 3*b* may be driven by a motor (not illustrated), and the other may function as a subordinate roller. A pair of conveyance rollers 3*a*, 3*b* is configured so as to convey paper 2 while holding paper 2 sandwiched between conveyance rollers 3*a*, 3*b* at predetermined pressure.

Figure 2:
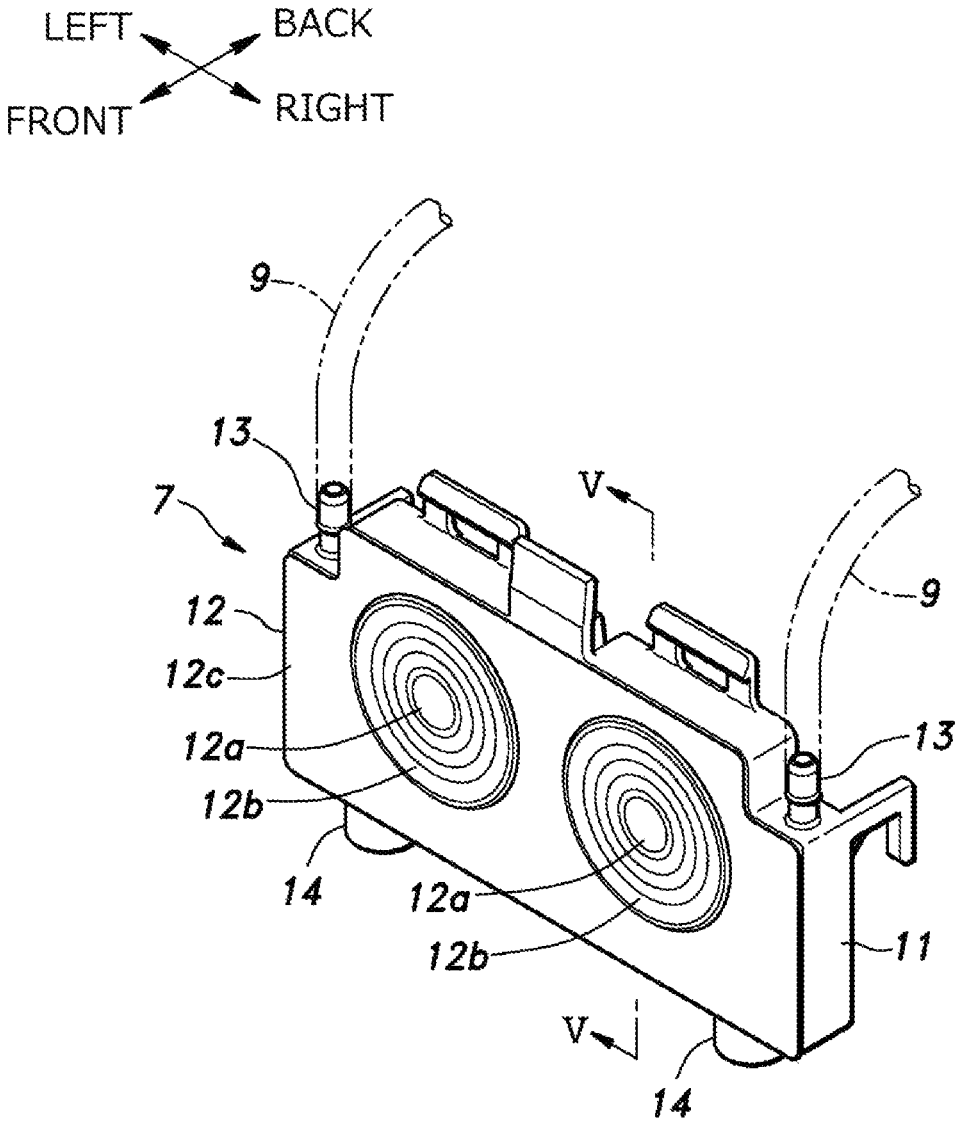
FIG. 2 is a perspective view of a damper device in the embodiment of the present disclosure.

FIG. 2 is a perspective view illustrating damper device 7. In the following description, in a case where positional relation is described, a front and back direction and a right and left direction illustrated by arrows in the figures are appropriately used for convenience. Case 11 of damper device 7 is formed of thin plate in a horizontally long outer shape having protruding portion. Diaphragm plate 12 as a flexible plate formed by a flexible resin film member is firmly fixed onto a surface of case 11 by thermal welding. Hose-nipple shaped joints 13 connected to respective tubes 9 are disposed protruding from shoulders at both ends in the right and left direction which is a horizontally long direction of case 11. In the description hereinafter, since two ink supply structures in damper device 7 are bilaterally disposed in symmetrical manner, only one of the ink supply structures will be described otherwise mentioned.

Figure 3:
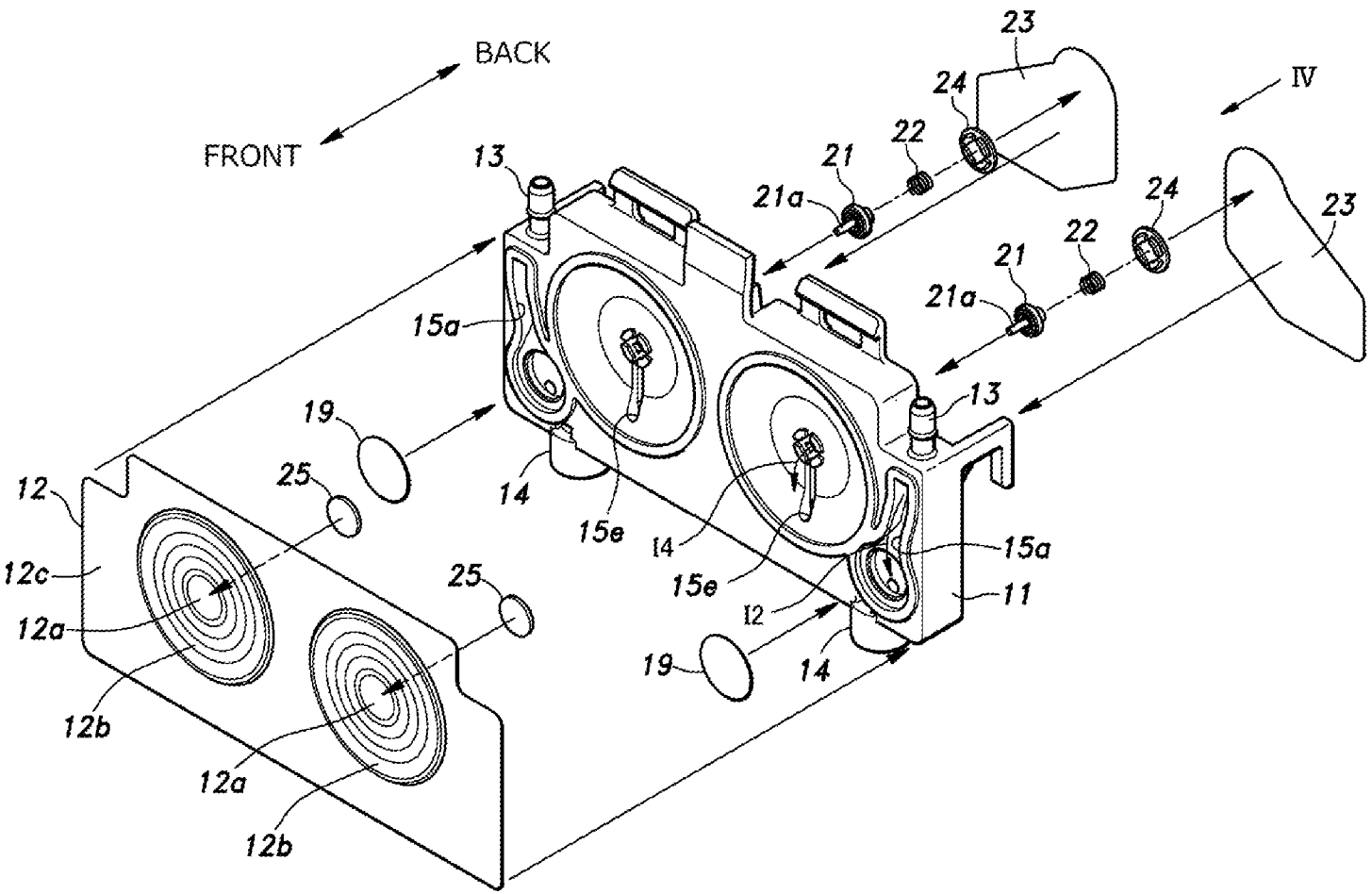
FIG. 3 is an exploded perspective view as viewed from a front surface side of the damper device.
Figure 4:
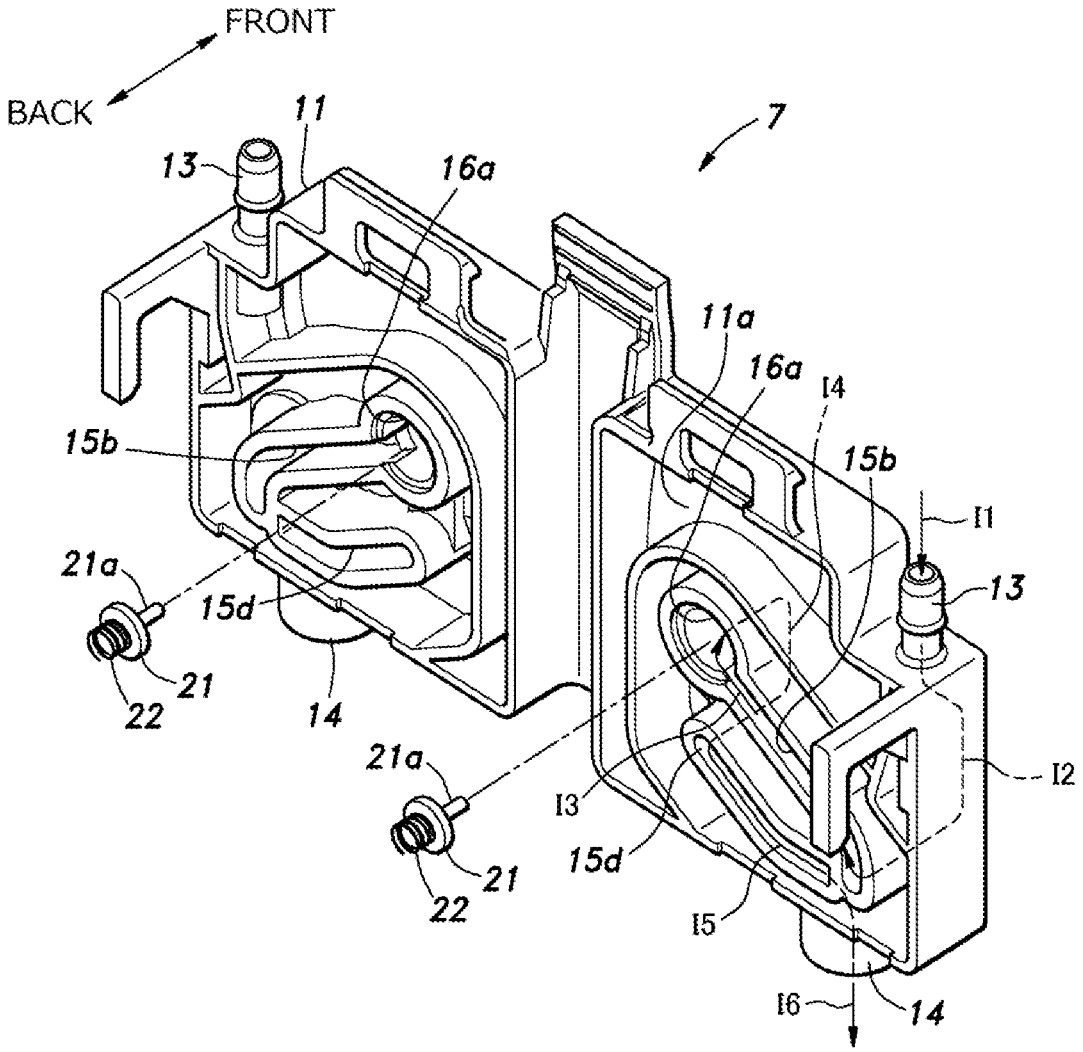
FIG. 4 is a perspective view of a case on a back surface side of the damper device as viewed from arrow IV direction of FIG. 3.
Figure 5:
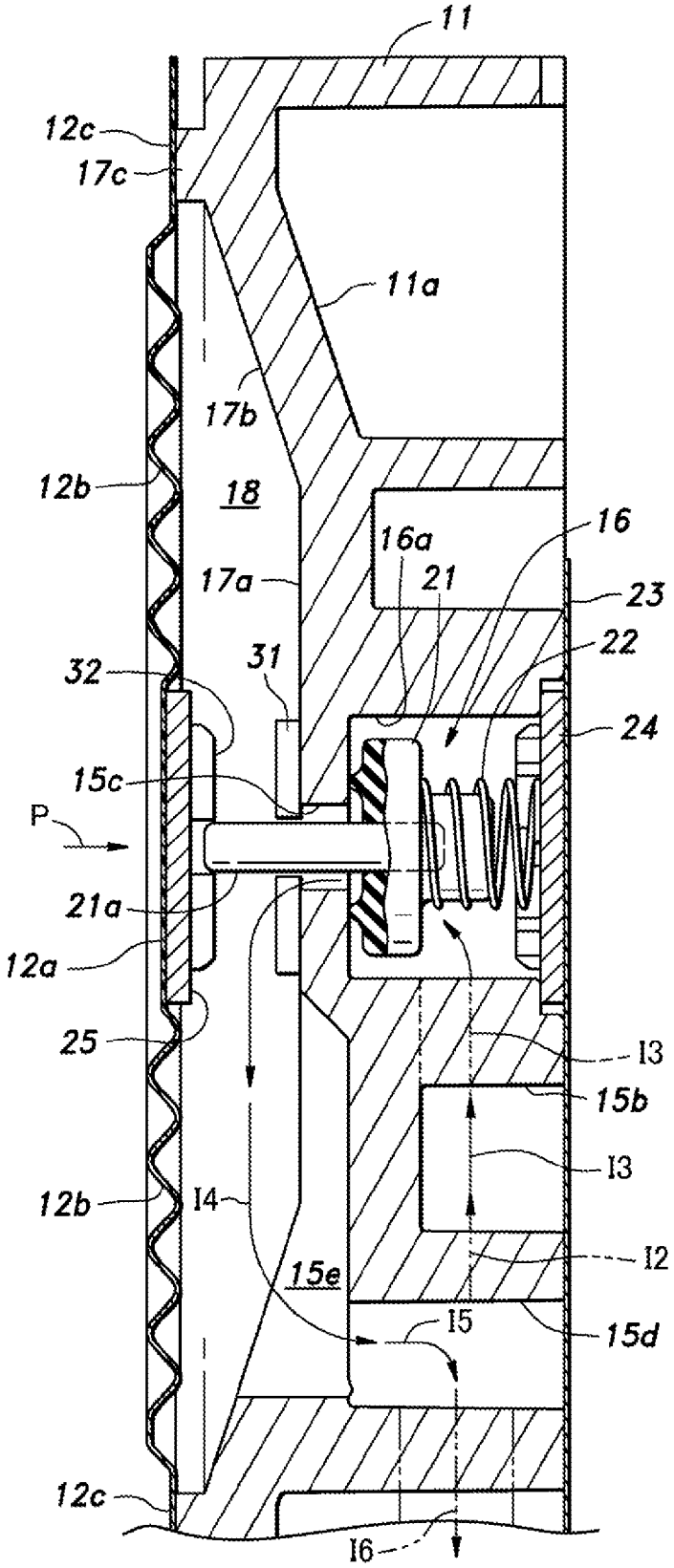
FIG. 5 is an enlarged sectional view of the main part along V-V line of FIG. 2 as viewed from the arrow direction.

FIG. 3 is an exploded perspective view as viewed from a side of one surface of damper device 7 (hereinafter referred to as a front surface). FIG. 4 is a perspective view of the other surface (hereinafter referred to as a back surface) side of case 11 as viewed from arrow IV direction in FIG. 3. FIG. 5 is an enlarged sectional view of the main part along V-V line of FIG. 2 as viewed from the arrow direction. Ink introduced into damper device 7 enters case 11 from joint 13, flows through a flow passage (described later) formed in case 11, and is supplied to printhead 6 from connection pipe part 14 protruding on a lower surface (printhead 6 side) of the both ends in the right and left direction of case 11, as illustrated by arrows 11 to 16 in the figure.

Case 11 is formed with partition wall Ha that defines a boundary between the front surface side and the back surface side. The above flow passage of ink is formed by an erected wall part provided at a suitable place on both front and back surfaces of partition wall 11*a*.

Vertical passage 15*a* that extends from joint 13 toward connection pipe part 14 is formed on a front surface side of partition wall 11*a*. A flow passage for allowing ink to flow in arrow 12 direction is formed by vertical passage 15*a*. A lower end part of vertical passage 15*a* penetrates through partition wall 11*a* to the back surface side. Upper ramp 15*b* that is communicated with vertical passage 15*a* at the lower end part is formed on a back surface side of partition wall 11*a*, and upper ramp 15*b* reaches a substantially central part of partition wall 11*a* in one of the ink supply structures. A flow passage for allowing ink to flow in arrow 13 direction is formed by upper ramp 15*b*. Communication path 15*c* is formed at the central part of partition wall 11*a*. Communication path 15*c* communicates with upper ramp 15*b* and penetrates to a front surface side of partition wall 11*a*. Communication path 15*c* is openably closed by ON-OFF valve 16 described later.

On the front surface side of partition wall 11*a*, circular flat surface 17*a* and tapered surface 17*b* are formed. Circular flat surface 17*a* has a center where communication path 15*c* is arranged to open. Tapered surface 17*b* is a conical surface expanding in a trumpet shape from an outer periphery of circular flat surface 17*a*. A bottom surface of pressure chamber 18, which is dish-like shape, is formed by circular flat surface 17*a* and tapered surface 17*b*. Circular rib-shaped peripheral wall part 17*c* is formed on an outer peripheral of tapered surface 17*b*, which is served as a peripheral edge of pressure chamber 18 in case 11. An inner surface of peripheral wall part 17*c* defines an outer periphery of pressure chamber 18.

Vertical groove 15*e* is provided in circular flat surface 17*a* and tapered surface 17*b*. Vertical groove 15*e* reaches an immediate part of tapered surface 17*b* downward from communication path 15*c*. A lower end part of vertical groove 15*e* penetrates through partition wall 11*a* to the back surface side. On the back surface side of partition wall 11*a*, lower ramp 15*d* communicating with the lower end part of vertical groove 15*e* is formed. Lower ramp 15*d* is disposed approximately in parallel with upper ramp 15*b*. Lower ramp 15*d* forms a flow passage for allowing ink to flow in arrow 15 direction which is toward connection pipe part 14. Lower ramp 15*d* is communicated with connection pipe part 14. As described above, the flow passage of ink is provided in case 11.

In a lower part of vertical passage 15*a*, filter 19 is fixed by thermal welding in front of a part communicated with upper ramp 15*b*. Consequently, in a case where impurities are contained in ink entering from joint 13, the impurities can be removed by filter 19. As described above, diaphragm plate 12, which is firmly fixed to a front surface of case 11 by thermal welding, shields an open side of dish-like shape formed by circular flat surface 17*a* and tapered surface 17*b*. Accordingly an atmospheric side of pressure chamber 18 is defined by diaphragm plate 12. An open side of vertical passage 15*a* at the front surface is also shielded by a part of diaphragm plate 12.

As illustrated in FIG. 5, valve chamber 16*a* is formed on a back surface side of the substantially central part of partition wall 11*a* in one of the ink supply structures. A inner wall of valve chamber 16*a*, which is a shape of cylinder coaxial with communication path 15*c*, surrounds a part communicated with communication path 15*c* of upper ramp 15*b* through communication path 15*c*. Valve chamber 16*a* configures a part of the ink introduction passage communicated with tube 9.

Valve chamber 16*a* accommodates valve body 21 that is formed in a shape of a disk having a size enabling communication path 15*c* to be closed. In valve body 21, pin-like valve shaft 21*a*, which penetrates through communication path 15*c*, is provided coaxial and integral with valve body 21. On a side opposite to valve shaft 21*a* of valve body 21, a protruding boss part which protrudes on valve body 21 is disposed. Coil spring 22 is coaxially fitted around the protruding boss part. Coil spring 22 urges valve body 21 in a direction in which communication path 15*c* is closed. The spring for urging valve body 21 in the valve closing direction is not limited to coil spring 22, and other various types of springs are applicable.

On a back surface side of case 11, shielding plate 23 is firmly fixed by thermal welding. Shielding plate 23 shields open sides of valve chamber 16*a*, upper ramp 15*b* and lower ramp 15*d*. Plate 24 is firmly fixed to shielding plate 23. Plate 24 is in contact with other end of coil spring 22. Coil spring 22 is interposed between valve body 21 and plate 24 in a state where communication path 15*c* is closed. Consequently, an initial load in the valve closing direction of valve body 21 is set.

Diaphragm plate 12 integrally has flat part 12*a*, waveform portion 12*b*, and flange part 12*c*. Flat part 12*a* is formed in a circle at the central part. Waveform portion 12*b* is formed in an annular part which reaches peripheral wall part 17*c* defining an outer periphery of pressure chamber 18 from an outer periphery of flat part 12*a*. Flange part 12*c* extends outside from an outer periphery of waveform portion 12*b* in radial direction, and is formed in an outer shape identical with an outer shape of case 11. Circular thin plate 25 is firmly fixed on a side, close to pressure chamber 18, of flat part 12*a*. Plate 25 and valve shaft 21*a* configure a transmission member for transmitting displacement of diaphragm plate 12 to valve body 21.

Waveform portion 12*b* is formed so as to make concentric ripples between flat part (plate 25) 12*a* and peripheral wall part 17*c* serving as an outer periphery, viewed from an axial direction (front and back direction) of diaphragm plate 12. Waveform portion 12*b* is also formed so as to have such a sectional shape that amplitude of a wave is repeated, as illustrated in FIG. 5. In a first exemplary embodiment, waveform portion 12*b* is formed so as to repeat identical amplitude W of each wave. For example, amplitude W of each wave may be 2 mm. Inner and outer diameters of waveform portion 12*b* may be arbitrary set in response to deflection ability of a film member described later, pressure fluctuation of ink during printing, or the like.

Figure 6:
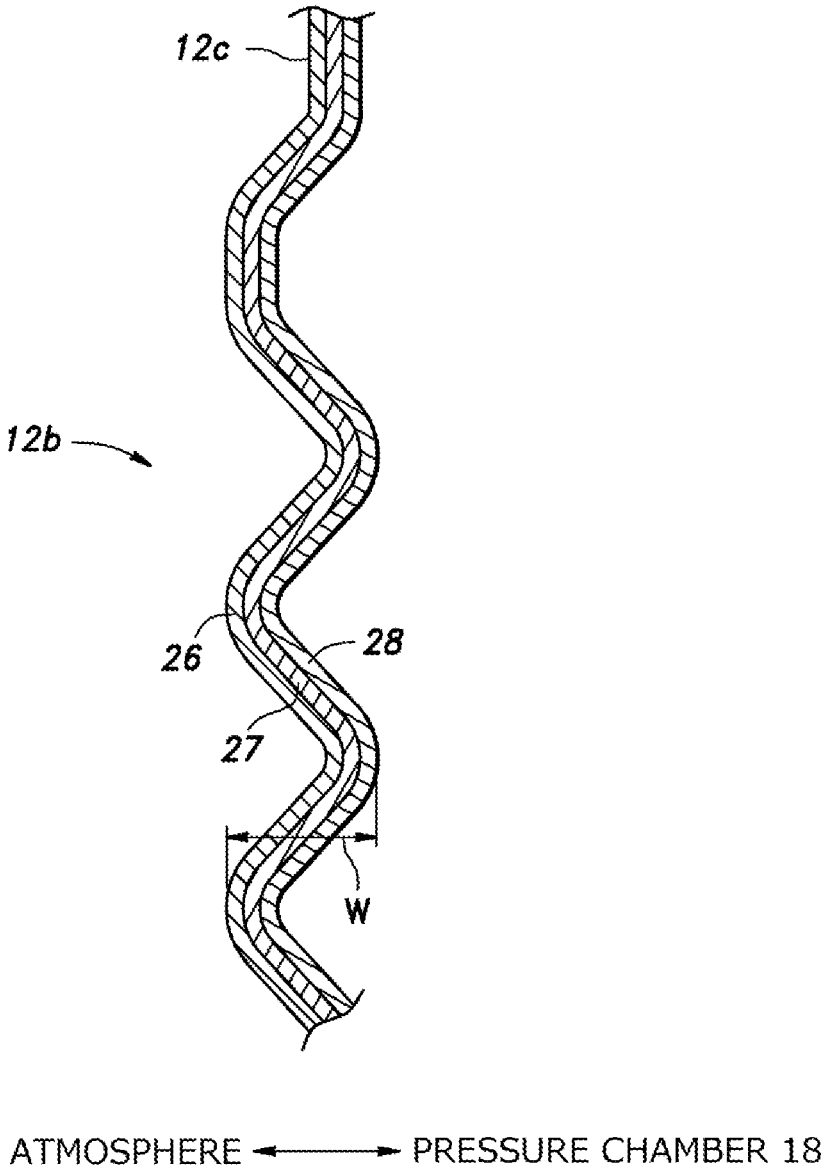
FIG. 6 is an enlarged sectional view of the main part illustrating a sectional shape of a waveform portion of a diaphragm.

FIG. 6 is an enlarged sectional view of the main part illustrating a sectional shape of waveform portion 12*b*. As illustrated in the figure, diaphragm plate 12 has a three-layer structure in which barrier layer 26, adhesive layer 27, and welding layer 28, all of which are formed of respective resin films, are laminated from the atmospheric side which is a side opposite to pressure chamber 18. Barrier layer 26 has an oxygen barrier property. Welding layer 28 is bonded to barrier layer 26 with adhesive layer 27 interposed between welding layer 28 and barrier layer 26, and firmly fixed to peripheral wall part 17*c* being a part of case 11 by thermal welding. For example, barrier layer 26 may be formed of barrier nylon having a thickness of 15 μm, adhesive layer 27 may be formed of polyethylene having a thickness of 15 μm, and welding layer 28 may be formed of a CPP film having a thickness of 30 μm. In the above embodiment, diaphragm plate 12 has the three-layer structure configured by barrier layer 26, adhesive layer 27, and welding layer 28. However, barrier layer 26 and welding layer 28 are formed of materials capable of being bonded to each other, so that adhesive layer 27 can be omitted.

Diaphragm plate 12 may be formed by thermoforming. A heating temperature during this thermoforming is lower than a temperature when welding layer 28 is thermally welded. Thus, barrier layer 26 and welding layer 28 are bonded to each other with adhesive layer 27 interposed between barrier layer 26 and welding layer 28 by thermoforming. Consequently, waveform portion 12*b* is positioned inside peripheral wall part 17*c*, flange part 12*c* is thermally welded to a protruding directional edge face of peripheral wall part 17*c*, so that diaphragm plate 12 obtained by integration of the three layers is integrated with case 11. Plate 25 is also firmly fixed to flat part 12*a* by thermal welding.

Receiving side guide plate 31 is mounted on a part surrounding communication path 15*c* on a side, close to pressure chamber 18, of partition wall 11*a*. Receiving side guide plate 31 has a cross-shaped hole for guiding valve shaft 21*a*. Pressing side guide plate 32 is disposed at a position opposed to receiving side guide plate 31. Pressing side guide plate 32 has a cross-shaped hole for receiving a protruding end of valve shaft 21*a*. Pressing side guide plate 32 receives the protruding end of valve shaft 21*a* with a gap from plate 25 at an initial state of diaphragm plate 12. Consequently, lost motion operation of valve body 21 to movement of receiving side guide plate 31 is obtained. Further, an engagement between the protruding end of valve shaft 21*a* and pressing side guide plate 32 is ensured, so that valve shaft 21*a* and pressing side guide plate 32 can be prevented from being detached from each other.

In damper device 7, when ink is consumed by printhead 6, ink flows as illustrated by arrows 14 to 16, and therefore ink in pressure chamber 18 is reduced. The atmospheric side of diaphragm plate 12 is pressed by atmospheric pressure, and therefore pressure in pressure chamber 18 becomes negative pressure relative to atmospheric pressure. Thus, plate 25 moves to pressure chamber 18 side as illustrated by arrow P. Valve shaft 21*a* is pressed by the displacement of plate 25. However, when load by plate 25 is smaller than urging force of coil spring 22, valve body 21 is in a valve closing state.

When printing proceeds and ink is further consumed, the negative pressure in pressure chamber 18 becomes high, so that load to valve shaft 21*a* by plate 25 increases. Thus, valve body 21 is displaced in the direction of arrow P against urging force of coil spring 22, and communication path 15*c* is brought into a valve opening state. Valve chamber 16*a* is filled with ink introduced from ink cartridge 8 through tube 9, as illustrated by arrows I1 to I3. Since atmospheric pressure acts on ink inside valve chamber 16*a*, the ink inside valve chamber 16*a* enters pressure chamber 18 through communication path 15*c* by opening the valve for communication path 15*c*.

The ink enters pressure chamber 18, so that pressure of the ink inside pressure chamber 18 approaches an atmospheric pressure state from a negative pressure state. Thus, load to valve shaft 21*a* by plate 25 is reduced, and then valve body 21 is pressed back by coil spring 22. Consequently, communication path 15*c* returns to a valve closing state. As described above, communication path 15*c* is open or closed by valve body 21 with consumption of ink during printing, and therefore pressure or a filling amount of ink inside pressure chamber 18 is kept at a predetermined state. Consequently, pressure fluctuation of ink is relaxed, and ink, is supplied to printhead 6.

In ink jet printer 1 that performs printing by reciprocating movement of printhead 6, rapid direction change occurs at reciprocation both ends of carriage 5 on which printhead 6 is mounted, and therefore the movement causes large bending deformation in tube 9. Consequently, since pressure of ink inside tube 9 is largely fluctuated, pressure of ink inside valve chamber 16*a* may be sometimes reduced (becomes negative pressure). In this case, force for moving valve body 21 in the valve opening direction acts on valve body 21, and therefore valve body 21 may be opened.

In a case where communication path 15*c* is opened by the influence of negative pressure in valve chamber 16*a*, ink inside pressure chamber 18 is returned to valve chamber 16*a*. When pressure or a filling amount of ink inside pressure chamber 18 is changed in normal operation, this change affects the flow of ink with ink consumption described above. Consequently, printing quality may be degraded.

In order to prevent such valve opening operation by large pressure fluctuation of ink due to the deformation of tube 9, urging force of coil spring 22 to valve body 21 can be increased, in a case where the urging force of coil spring 22 is increased, it is considered that a spring constant may be increased, or a compressive deformation amount may be increased.

In a case where a film-like film member is provided with deflection like a conventional technology and a displacement of a diaphragm, which is namely a plate (corresponding to plate 25 of this illustrated example), is ensured by the deflection, a coil spring compressive deformation amount of a coil spring becomes small. Therefore the spring constant has to be increased in order to cope with this situation. In this case, if load of the plate is the same, a displacement (valve opening amount) of a valve body is reduced. Consequently, it adversely affects a flow of replenishment of ink during the normal operation, and adversely affects printing quality as well.

Figure 7:
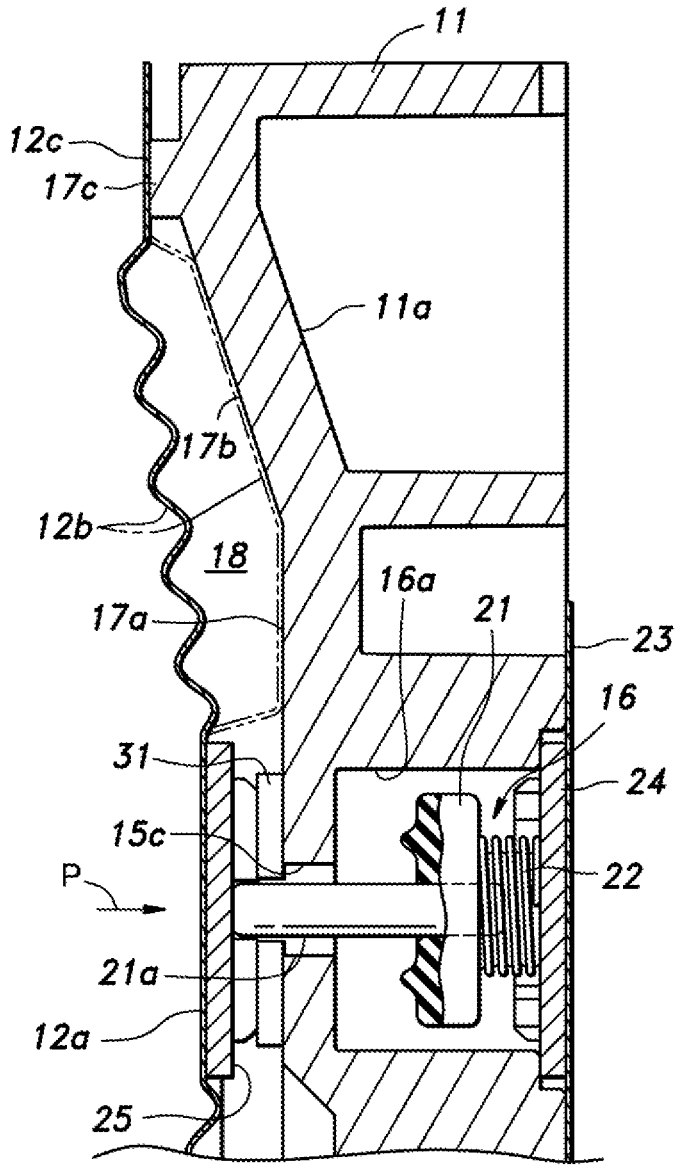
FIG. 7 is an enlarged sectional view of the main part illustrating a state where valve opening is maximized.

According to the present disclosure, ripple-like waveform portion 12*b* is provided in diaphragm plate 12, and a displacement of plate 25 can be increased by extending deformation of waveform portion 12*b*. For example, magnitude of amplitude or a number of waves of waveform portion 12*b* can be set based on a state where plate 25 is in contact with partition wall 11*a* with waveform portion 12*b* extending as shown by chain double-dashed lines in FIG. 7 which illustrates a state where valve opening is maximized. Consequently, the displacement of plate 25 can be significantly increased, and therefore it is possible to ensure a large compressive deformation amount to increase spring urging force at a valve opening position without increase of the spring constant of coil spring 22. As described above, the magnitude of the amplitude or the number of waves of waveform portion 12*h* may be set based on such a length that a substantially whole of waveform portion 12*b* sticks to a bottom surface of pressure chamber 18 (circular flat surface 17*a* and tapered surface 17*b*) when waves of waveform portion 12*b* are totally extended. Waveform portion 12*b* is designed to set the length to a maximum value, so that it is possible to eliminate waste of a material of the film member.

As described above, since a large opening amount of the valve can be obtained by small change (increase) of load to valve shaft 21*a*, replenishment of a suitable amount of ink by a smooth flow from damper device 7 to printhead 6 is ensured in normal ON-OFF valve operation. Also when spring urging force in the valve closing direction of valve body 21 is increased in order to prevent an influence of pressure fluctuation on an ink introduction side by the reciprocating movement of carriage 5 during printing in ink jet printer 1, the increase in the spring urging force does not adversely affect the flow of ink in the normal operation. Therefore it is possible to always perform high quality printing.

Since the shape of waveform portion 12*b* provided between flat part 12*a* and flange part 12*c* is held by waveform sectional shape in a case where a pressure difference between a front (atmospheric side) and a back (pressure chamber 18 side) is not generated, securement of designed capacity of pressure chamber 18 is optimized. In a case where the pressure inside pressure chamber 18 becomes negative pressure, plate 25 is displaced so as to be recessed with respect to the atmospheric side, and bending force acts on waveform portion 12*b* by the displacement. Wave-like waveform portion 12*b* is easily bent and deformed by this bending force. Since flange part 12*c* supports flat part 12*a* through waveform portion 12*b* easily bent and deformed, it is possible to easily perform positioning and mounting work of diaphragm plate 12 to case 11. For example, even when plate 25 is not located concentrically with an outer peripheral circle of waveform portion 12*b*, deviation of a position by wave-like bending deformation of waveform portion 12*b* is absorbed, and therefore it is possible to simplify assembly work without requirement of high precision in positioning fixing of plate 25 to flat part 12*a*.

Figure 8:
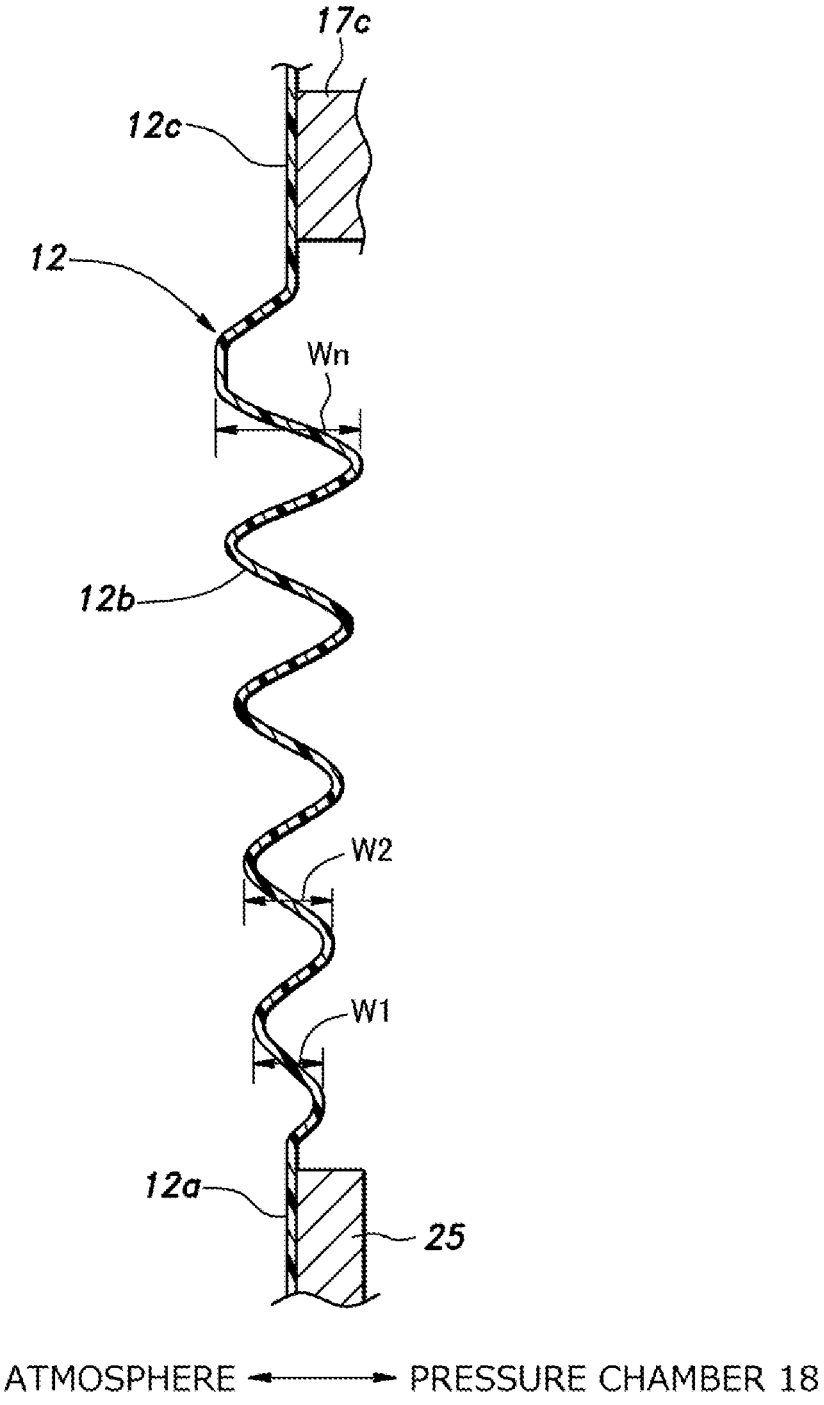
FIG. 8 is an enlarged sectional view of a main part of a waveform portion illustrating a second exemplary embodiment.

FIG. 8 is an enlarged sectional view of a main part illustrating a waveform portion of a second exemplary embodiment. Parts similar to the parts of the above exemplary embodiment are denoted by the same reference numerals in the figure, and detailed description of the parts is omitted. As illustrated in the figure, in the second exemplary embodiment, a waveform portion is formed such that amplitude of a wave of the waveform portion on a peripheral wall part (outer periphery of the waveform portion) side is larger than amplitude of a wave of the waveform portion on plate 25 (flat part) side ($W1<W2< \ldots <Wn$). In an illustrated example, amplitude (W1, W2, . . . , Wn) gradually increases from a central part (plate 25) side toward the outer periphery. However, a shape of the waveform portion is not limited to the continuously increasing shape. For example, waveform portion 12*b* may be formed such that each wave in a radial inside has identical small amplitude, and each wave in a radial outside has identical large amplitude, when a radial intermediate part is served as a boundary between the radial inside and the radial outside.

In waveform portion 12*b* of the second exemplary embodiment, a pressure receiving area per unit radial length increases toward the radial outside, and therefore load received on an outer peripheral side becomes larger than load received on a central part (flat part 12*a*) side. A deformation allowance on the outer peripheral side of waveform portion 12*b* is larger than a deformation allowance on the central part side by the above shape. Consequently, an increase in a deformation amount on the outer peripheral side of waveform portion 12*b* can be facilitated corresponding to load increase on the outer peripheral side.

A deformation amount on plate 25 (flat part 12*a*) side is reduced, so that a displacement of plate 25 can be ensured by deformation on the outer peripheral side of waveform portion 12*b*. In waveform portion 12*b*, a deformation amount in a vicinity of plate 25 is relatively small, and therefore falling of plate 25 with respect to a direction for pressing valve shaft 21*a* is suppressed, and balance during movement of plate 25 is ensured. For example, also inn a case where valve shaft 21*a* is pressed at a position deviated from the center of plate 25, plate 25 can be moved in a state where falling is suppressed, deviation in a load direction with respect to a moving direction of valve shaft 21 is suppressed, and therefore it is possible to stabilize valve opening operation of valve shaft 21*a*, namely, valve body 21.

As described above, exemplary embodiments in the preferred exemplary embodiments of the present disclosure are described, but the present disclosure is not limited to such exemplary embodiments, and is appropriately changeable without departing from the spirit of the present disclosure such that those skilled in the art can easily understand. For example, waveform portion 12*b* is formed such that waves are continuous in a radial whole range of waveform portion 12*b*, but waveform portion 12*b* may be formed such that waves are partially continuous, and a flat part is formed in other parts. The shape of waveform portion 12*b* may be waves other than concentric circular waves. For example, the shape of waveform portion 12*b* may be waves parallel to each other, or may be a spiral wave. Additionally, all the components described in the above exemplary embodiments are not always essential, but can be appropriately selected without departing from the scope of the present disclosure.

An ink supply device for a printhead according to the present disclosure is useful for an ink jet printer for business use capable of suppressing an influence by pressure fluctuation of ink, capable of keeping good printing quality without reduction in a valve opening amount during normal printing, and connecting a printhead and an ink cartridge through a flexible tube.

What is claimed is:

1. An ink supply device for a printhead, the ink supply device comprising:

an ink cartridge that is connected to the printhead through a flexible tube, the printhead being mounted on a carriage that reciprocates, and discharging an ink drop to perform printing; and a damper device that is mounted on the carriage to relax pressure fluctuation of ink supplied from the ink cartridge to the printhead, wherein the damper device has:

a case that defines a pressure chamber communicated with the printhead;

an ink introduction passage that is communicated with the flexible tube, and is communicated with the pressure chamber;

a valve body that is provided between the ink introduction passage and the pressure chamber;

a spring that urges the valve body in a valve closing direction;

a flexible plate that is provided so as to define a part of the pressure chamber and receive atmospheric pressure; and a transmission member that is provided between a predetermined part of the flexible plate and the valve body to transmit displacement of the flexible plate to the valve body, and wherein the flexible plate has a waveform portion formed with a plurality of waveforms, and has:

a barrier layer which is formed of a film member, is provided on a side receiving atmospheric pressure, and has an oxygen barrier property;

a welding layer that is fixed to the case by thermal welding; and an adhesive layer that bonds the barrier layer and the welding layer.

2. The ink supply device for a printhead according to claim 1, wherein the waveform portion has a large amplitude of waveform on at least a part of an outer peripheral side in the flexible plate.

3. The ink supply device for a printhead according to claim 2, wherein the amplitude of waveform in the waveform, portion on the part of the outer peripheral side in the flexible plate is larger than an amplitude of waveform in the waveform portion on a part of a central side in the flexible plate.

4. The ink supply device for a printhead according to claim 1, wherein the waveform portion is formed with such a length so as to stick to at least a wall surface of the pressure chamber at an extending state.

* * * * *